US005591265A

United States Patent [19]

Tusch

[11] Patent Number: 5,591,265

[45] Date of Patent: Jan. 7, 1997

[54] PROTECTIVE COATING

[75] Inventor: Klaus N. Tusch, London, England

[73] Assignee: Colebrand Limited

[21] Appl. No.: 275,814

[22] Filed: Jul. 15, 1994

Related U.S. Application Data

[63] Continuation of Ser. No. 879,812, May 7, 1992, abandoned.

[30] Foreign Application Priority Data

May 10, 1991 [GB] United Kingdom ..... 9110097

[51] Int. Cl.[6] ..... B05C 3/02; E02D 5/60

[52] U.S. Cl. ..... 118/404; 405/216

[58] Field of Search ..... 118/404, 405, 118/DIG. 11, DIG.12; 15/302; 134/199; 405/216; 425/129.1

[56] References Cited

U.S. PATENT DOCUMENTS

| | | | |
|---|---|---|---|
| 924,452 | 6/1909 | Graham | 118/440 |
| 1,662,852 | 3/1928 | De La Mare | 118/DIG. 11 |
| 1,949,234 | 2/1934 | Baxter | 118/404 |
| 2,032,747 | 3/1936 | Harrison | 118/DIG. 11 |
| 2,305,005 | 12/1942 | Henry | 118/DIG. 11 |
| 3,209,723 | 10/1965 | Schrodersecker | 118/404 |
| 3,443,881 | 5/1969 | Hudson | 118/404 |
| 3,908,593 | 9/1975 | Rossi et al. | 118/DIG. 11 |
| 4,007,705 | 2/1977 | Sherer et al. | 118/307 |
| 4,041,198 | 8/1977 | McPherson | 118/DIG. 11 |
| 4,077,224 | 3/1978 | Coone . | |
| 4,270,484 | 6/1981 | Shimatani et al. | 118/305 |
| 4,328,267 | 5/1982 | Matsuo | 427/345 |
| 4,415,293 | 11/1983 | Engel et al. . | |
| 4,423,700 | 1/1984 | Nguyen et al. | 118/DIG. 11 |
| 4,815,488 | 3/1989 | Lyons | 118/DIG. 11 |
| 5,199,226 | 4/1993 | Rose | 118/DIG. 11 |

FOREIGN PATENT DOCUMENTS

| | | |
|---|---|---|
| 2028405 | 5/1980 | United Kingdom . |
| 2084488 | 4/1982 | United Kingdom . |
| 2159561 | 4/1985 | United Kingdom . |
| 2163468 | 2/1986 | United Kingdom . |

*Primary Examiner*—Brenda A. Lamb
*Attorney, Agent, or Firm*—Emrich & Dithmar

[57] ABSTRACT

The invention relates to a system for providing a protective coating to a body such as a tubular structure. An annular formwork is erected encircling the structure leaving an annular gap between the formwork and the structure. Resin is injected into the annular space. The formwork may comprise two hemi-cylindrical parts which are clamped together by clamp means.

8 Claims, 2 Drawing Sheets

PROTECTIVE COATING

This is a continuation of application Ser. No. 07/879,812 of May 7, 1992, now abandoned.

The invention relates to protective coating, particularly to the application of a protective coating to a body and is particularly useful for use with bodies which are wholly or partly under water, though the invention may be utilised out of water.

Most structures need a protective covering to prolong their life, particularly against corrosion. In the underwater environment, particularly close to the surface where there is plenty of oxygen in the water, corrosion by rusting and plant growth can be a serious nuisance, both in reducing the strength of the structure and adding to its weight so that the structure may become unstable. The application of protective paints or other coatings by a brush is impractical under water and it has previously been proposed to apply a protective coating by making it into the form of a putty and applying it by hand. It is difficult to achieve a complete coating in this manner and in particular a uniform coating so that much material is wasted.

It is an object of the invention to seek to mitigate this disadvantage.

According to the invention there is provided a system for applying a protective coating to a body, comprising a formwork adapted to be placed round the body, spacer means for spacing the formwork from the body, means to clamp the formwork round the body to leave an annular space therebetween, and means to apply a resin material to the annular space whereby to provide the protective coating between the formwork and the body.

Using the invention a resin can be applied to a body or structure between the structure and surrounding formwork. The formwork provides control of the space to be occupied by the resin around the structure and supports the resin until it is cured. The formwork can then be removed or it may be retained to provide additional protection of the structure.

There may be a plurality, preferably six, of spacer means. This provides for an equalising support force.

The formwork may comprise an elongate tubular member which may have a longitudinal slot whereby the formwork can be mounted on the member. This provides for ease of handling.

There may be a plurality of similar tubular member whereby two members are mountable adjacent one another along an elongate body to provide a substantially continuous elongate formwork. This provides for provision of various lengths of formwork.

Each member may have end connection means whereby one member is engageable with another similar member. This provides for effective sealing against resin leakage.

Leakage prevention may be enhanced by a seal means adjacent one end of a tubular member, particularly a seal means which may comprise an inflatable ring seal means.

The formwork may comprise two hemi-cylindrical formwork parts. This provides for ease of mounting round an elongate body.

According to a second aspect of the invention there is provided a workpiece, comprising a body to be coated, in combination with a system according to any preceding paragraph.

The formwork may be removed subsequent to curing of the resin.

A system embodying the invention is hereinafter described, by way of example with reference to the accompanying drawings.

The drawings show a body in the form of a tubular structure 11 to be protected. The structure is cleaned as far as possible and high pressure water jets or grit blasting may be used. Cleaning is not critical because the encapsulation of the structure by resin will isolate any remaining corrosion or growth and no further corrosion of or growth on the structure will be allowed to occur after encapsulation.

Figure 4A:
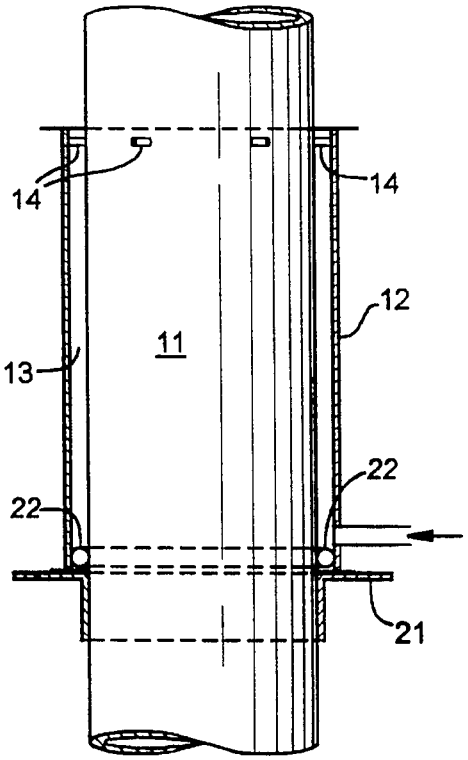
FIGS. 4A and 4B show elevational and plan views of further details of the system, particularly within the formwork.
Figure 4B:
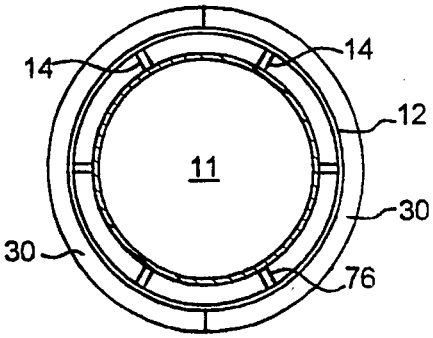

An annular formwork 12 is erected encircling the structure leaving an annular gap 13 between the formwork and the structure controlled by spacer members 14 which in the embodiment are equally spaced around the structure, six being shown in FIG. 4B and which form resin thickness control spacers. The formwork 12 is supported on a support ring 21 secured to the structure at a sufficient depth below water level below which no further protective coating is required. An inflatable ring seal 22 seals the bottom of the annular space between the structure and the formwork above the support ring. Immediately above the seal an injection point 23 is provided in the formwork through which resin 42 is injected into the annular space 13 between the structure 11 and the formwork 12 and as resin is injected, water in that annular space 13 is forced out of the space at the top of the formwork. When the annular space 13 has been completely filled by resin 42, it is cured to provide a sheathing 45 after which the formwork 12 can be removed if required.

The material of the resin 42 and/or the formwork 12, if it is retained in position after curing of the resin, is chosen to inhibit further plant growth and corrosion. Polyethylene and glass-reinforced plastics are particularly suitable materials and the formwork exterior may also be lined with copper in important locations (for example by a copper mesh being embedded in the formwork outer surface) to prevent fouling occurring—the copper and the metal of the structure setting up an electrolytic cell.

Figure 3A:
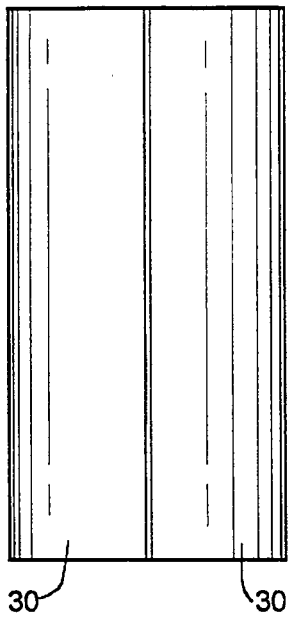
FIGS. 3A, 3B and 3C show respectively the formwork in sections in elevation and plan and joined together around the structure.
Figure 3B:
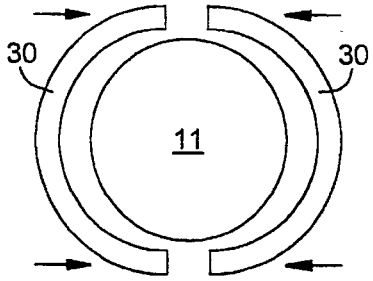
Figure 3C:
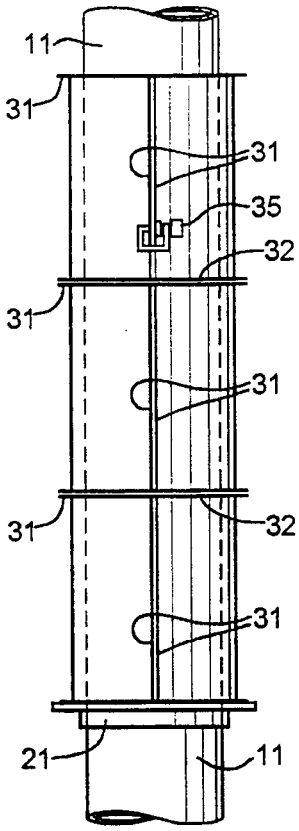

FIG. 3 shows how the formwork 12 may be formed in hemi-cylindrical sections 30. The edges of the sections may be flanged at 31 to assist joining together, particularly at the joints 32 running transversely of the length of the structure. The hemi-cylindrical sections are suitably secured together by securing means such as 35 in FIG. 3C, 35, as shown in the drawings FIGS. 3A and 3B.

Figure 1:
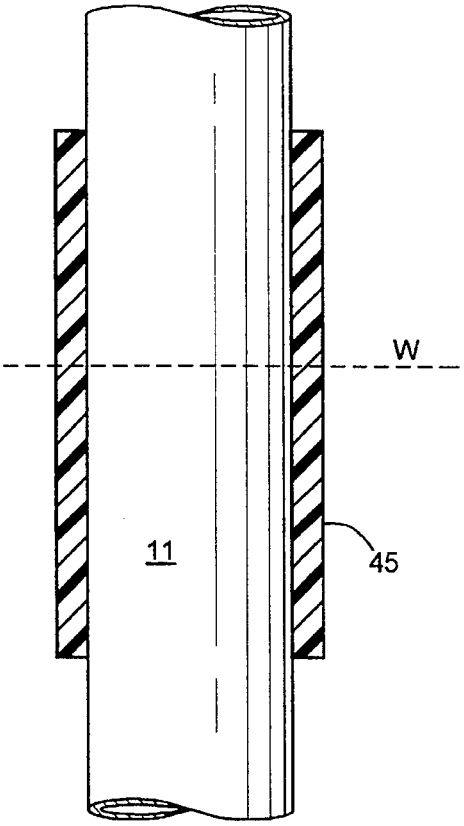
FIG. 1 shows in diagrammatic form a tubular structure with an encircling formwork, according to the invention.
Figure 1A:
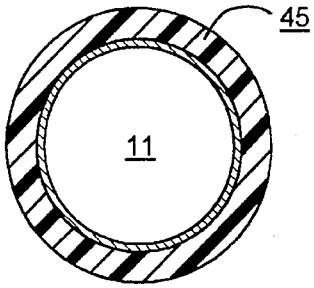
FIG. 1A shows a transverse cross-sectional view of the structure of FIG. 1.
Figure 2:
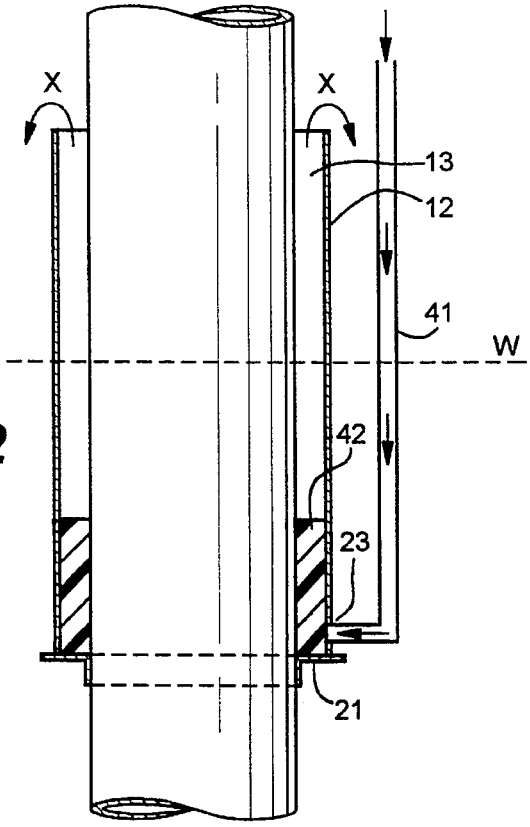
FIG. 2 shows in diagrammatic form the structure and formwork during the encapsulation process.

FIG. 2 shows resin supplied by a pipe 41 fed to the bottom of the formwork. Resin 42 is rising up the gap 13 and water is being forced out of the gap 13 at the top of the formwork 12 as shown by arrows 'X', FIG. 2.

FIG. 4A is only diagrammatic and it should be understood there is a space 13 between the formwork 12 and the tubular structure 11 which space 13 is sealed at the bottom end to prevent ingress of water and escape of resin. The spacer members 14 are preferably of a material compatible with the resin. The spacer members 14 may be formed with the formwork 12 or may be provided as separate components.

The system may be used in a splash or inter-tidal zone, and in this case the water level is shown by line 'W' in the drawings.

Thus the tubular body may comprise a leg of an oil drilling platform off-shore, and as such are shown substantially vertical in the drawings.

It will be understood, however, that the system is applicable in any orientation, for example horizontal, and above the water level 'W', that is out of the splash zone.

Two examples of resin constituents usable in the invention are set out below:

1) Underwater Encapsulation—High Impact Resistance 1.1 Elastomer modified Bisphenol A Epoxy Resin 1.2 Polyglycol Diepoxide resin 1.3 Silane coupling agent 1.4 Acrylate resin flow agent 1.5 Carbon Fibre 1.6 Modified adducted Fatty amine 1.7 Accelerated aliphatic amine 2. Above Water Encapsulation—Usually Horizontal Mode—High Resistance to Internal Pressure 2.1 Bisphenol A/Bisphenol F epoxy resin 2.2 Aromatic Amine A practical Example of the invention is given below:

EXAMPLE

APPLICATION OF MATERIAL—METHOD STATEMENT 6 lengths of pipe in total.

3×6½ OD 18 mm wall thickness 10 mm blanking plate

3×12% OD 9 mm wall thickness 10 mm blanking plate

End plates 21 of 10 mm thickness were welded to the ends of each pipe. A ½" BSP hole was drilled and tapped in each end plate and pressure testing was carried out to check the integrity of the weld.

In order to simulate wall damage a 10 mm hole was drilled in each pipe at approximately half distance along the length. For reference purposes the position of the hole is indicated by an arrow on one end blanking plate.

The 6 pipes were grit blasted using J Blast Fine Grit to Swedish standard SA 2.5 with an average profile of 75 um.

Galvanised sheathing was placed in position around the pipes and seals fitted at each end of the sheathing. In each item the 10 mm hole was filled with a removable plug and the resin pumped into the space between sheath and pipe. The temporary plug was removed after the initial curing period and the full system allowed to cure for 7 days.

HORIZONTAL RESIN ENCAPSULATION SYSTEM

Tests on the 6 resin encapsulated pipes were carried out at BSI (British Standards Institute) Testing, Hemel Hempstead.

Initial tests were undertaken with the sheathing 45 in place and although a 10 mm hole had been pre drilled in the pipe before encapsulation, no failure of the resin coating was detected. All tests were to 1000 bar (14,500 PSI)+one test to 1300 bar (18,850 PSI). These pressures were held over a number of hours (full report awaited from BSI Testing).

Further tests were then carded out with the sheathing removed. Identical results were obtained. BSI Testing remarked that the encapsulation is 'the toughest they have come across'.

Thus, using a system described herein with reference to the accompanying drawings, a sheath 45 is fitted in two sections to say a pile 11 of a drilling rig. It will be understood that the sheath can be custom made to fit various lengths, which can be joined to add further length.

The selected resin is then injected into the space between pile and sheath. The resin will vary according to the system selected. In all cases the cure cycle is rapid and takes place with no voids and a complete bond with the substrate is achieved. After curing the sheathing is usually removed—except where an anti-foulant is required or extra structural strength needed. The resin can be injected above or below water, thus ensuring that even in tidal or splash zone areas work can continue at a rapid rate.

I claim:

1. A system for applying a protective coating to a body having one end at least partially underwater, comprising:

(i) a formwork structured and arranged to be securely placed around the body, the formwork having at least a lower end partially underwater;

(ii) spacer means for spacing the formwork from the body to provide an annular space between the formwork and the body;

(iii) means structurally arranged adjacent the one end of the body to apply a resin material to said annular space whereby to provide the protective coating between the formwork and the body;

(v) seal means positioned between said means structurally arranged adjacent the one end of the body and the lower end of the formwork to prevent egress of said resin material from the the lower end of the formwork and to prevent ingress of water to said annular space; and (vi) a support ring secured to the body in use to support the lower end of the formwork.

2. A system as defined in claim 1, wherein there is a plurality of spacer means.

3. A system as defined in claim 1, wherein there are six spacer means.

4. A system as defined in claim 1, wherein the formwork is comprised of an elongated tubular member having a longitudinal slot therein whereby the formwork can be mounted on the body.

5. A system as defined in claim 4, wherein there is a plurality of said tubular members whereby the members are mountable adjacent one another along the body to provide a substantially continuous elongated formwork.

6. A system as defined in claim 5, wherein each said tubular member has end connection means whereby one member is engageable with another said tubular member.

7. A system as defined in claim 1, wherein the seal means comprises an inflatable ring seal means.

8. A system as defined in claim 1, wherein the formwork comprises two semi-cylindrical formwork parts, and means to clamp the formwork parts around the body to provide said annular space therebetween.

* * * * *

UNITED STATES PATENT AND TRADEMARK OFFICE

CERTIFICATE OF CORRECTION

PATENT NO. : 5,591,265
DATED : January 7, 1997
INVENTOR(S) : Klaus N. Tusch

It is certified that error appears in the above-indentified patent and that said Letters Patent is hereby corrected as shown below:

Column 2, line 34, after "formwork" insert -- 12 --;

Column 2, line 51, insert -- clamps -- before "35";

Column 2, line 51, delete second "35" after in FIG. 3C;

Column 3, line 35, delete "3 x 12" insert -- 3 x 12 5/8 --;

Column 4, line 1, delete "carded" insert -- carried --;

Claim 8,
Column 4, line 60, delete "semi" insert -- hemi --;

Claim 1,
Column 4, line 34, delete "(v)" insert -- (iv) --;

Claim 1,
Column 4, line 39, delete "(vi)" insert -- (v) --;

Signed and Sealed this

Twenty-ninth Day of April, 1997

Bruce Lehman

*Attest:*

BRUCE LEHMAN

*Attesting Officer*

*Commissioner of Patents and Trademarks*